United States Patent [19]

Diacont, Jr. et al.

[11] Patent Number: 4,476,792

[45] Date of Patent: Oct. 16, 1984

[54] FEED-THROUGH FOLDER APPARATUS

[75] Inventors: George P. Diacont, Jr.; James D. Grisham, both of Richmond, Va.

[73] Assignee: AMF Inc., White Plains, N.Y.

[21] Appl. No.: 502,842

[22] Filed: Jun. 9, 1983

Related U.S. Application Data

[63] Continuation-in-part of Ser. No. 250,814, Apr. 3, 1981, Pat. No. 4,395,963.

[51] Int. Cl.[3] ..... D05B 35/02

[52] U.S. Cl. ..... 112/142

[58] Field of Search ..... 112/142, 147, 153

[56] References Cited

U.S. PATENT DOCUMENTS 2,096,330 10/1937 Vesconte ..... 112/147

2,711,142 6/1955 Matthies ..... 112/147

3,121,412 2/1964 Greco ..... 112/147 X 4,395,963 8/1983 Diacont, Jr. et al. ..... 112/142

FOREIGN PATENT DOCUMENTS 483962 5/1927 Fed. Rep. of Germany ..... 112/142

*Primary Examiner*—Werner H. Schroeder

*Assistant Examiner*—Andrew M. Falik

*Attorney, Agent, or Firm*—David E. Dougherty; John H. Gallagher

[57] ABSTRACT

A folder for making Z-type folds in material as the material is fed therethrough, having a tongue creating slack in the material and a pair of folder blades cooperating to urge the slack material between the blades to form the fold as the material leaves the folder.

8 Claims, 6 Drawing Figures

FEED-THROUGH FOLDER APPARATUS

Figure 1:
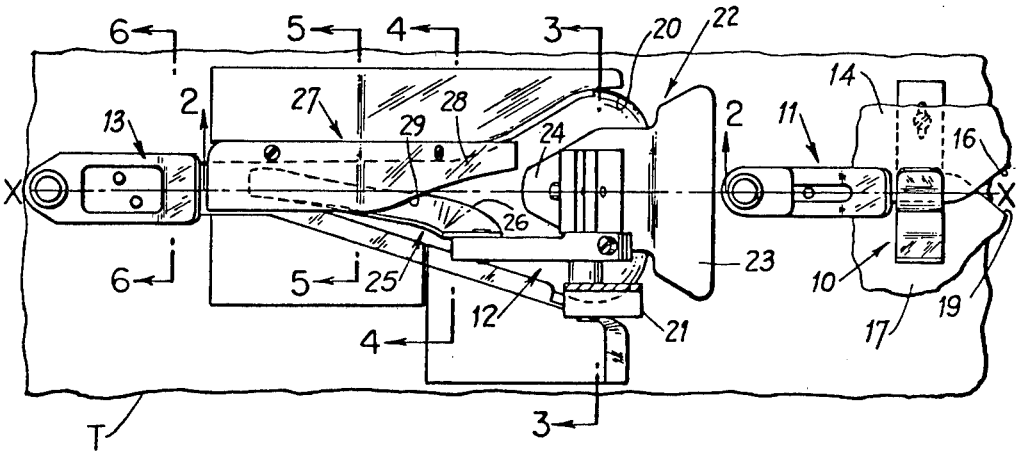

This is a continuation-in-part of U.S. application Ser. No. 250,814. Apr. 3, 1981, now U.S. Pat. No. 4,395,963. The present invention relates generally to apparatus for making lap seams and more particularly to apparatus for folding the material to form a lap seam.

As disclosed in application Ser. No. 250,814, two pieces of material are fed axially first through a double edge guide, providing a web, formed by a constant width overlap along the length of material. The overlapped material web is then stitched by a single needle head or otherwise connected together along the center of the overlap preferably midway between the cut edges of the material to retain the constant overlap. The novel folder or fold-over apparatus engages the cut edges of the web and the material outwardly thereof, and inverts the web or rotates the overlapped material 180° to form a pair of C-shaped interlocked material portions with a covered or hidden single row of stitches to form a folded lap seam. The folded lap seam is then sewn by a twin needle head in the usual manner adjacent to both folds of the seam.

The present folder or fold-over apparatus is arranged to automatically engage or receive the stitched overlapped material or web from the single needle head, fold-over the overlapped material web and appropriately present the folded unstitched lap seam to a twin needle head. It may be an integral part of a machine incorporating both single and twin needle heads axially aligned with one another. Alternatively, the folder may be provided with its own table as an independent piece of apparatus which is interposed in alignment between the sewing tables of a single and a twin needle machine and, for further versatility, material may be fed through a double edge guide and a single needle machine at one sewing station to provide sewn lapped material which, at a later time, can be fed through the novel folder and a twin needle machine at another sewing station to make the final lap seams.

An object of the present invention is to provide apparatus to fold the sewn overlapped portions of two pieces of material and to form an unsewn lap seam of constant width and thickness which is then presented to a twin needle machine for final stitching.

Another object of the present invention is to provide the foregoing folder or fold-over apparatus for making lap seams of constant width and thickness in which the initial stitching joining two pieces of material together is not visible when the lap seam is completed.

And another object of the present invention is to provide a novel folder or fold-over apparatus between single and twin needle machines for folding joined overlapped portions of material for making lap seams.

The foregoing and other objects and advantages will appear more fully hereinafter from a consideration of the detailed description which follows, taken together with the accompanying drawings, wherein a single embodiment of the invention is illustrated by way of example. It is to be expressly understood, however, that the drawings are for illustration purposes only and are not to be construed as defining the limits of the invention.

FIG. 1 is a plan view of apparatus embodying the novel folder or fold-over apparatus for making lap seams.

Figure 2:
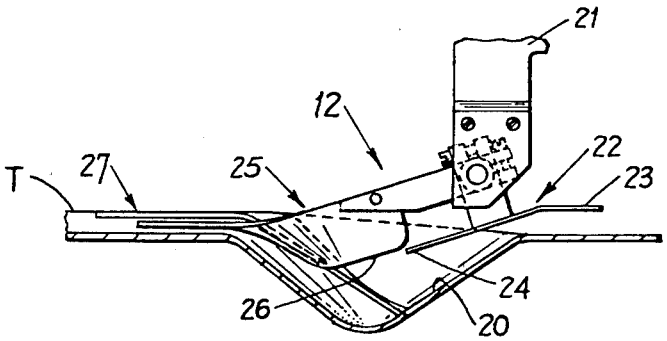
Figure 3:
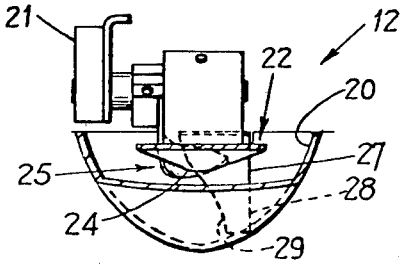
Figure 4:
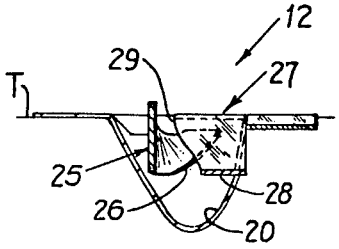

FIGS. 2, 3 and 4 are sectional views of the novel folder or fold-over apparatus taken substantially on lines 2-2, 3-3 and 4-4 respectively, of FIG. 1.

Figure 5:
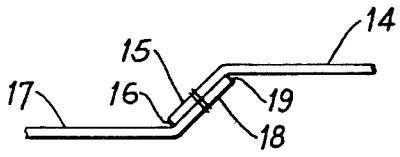
Figure 6:
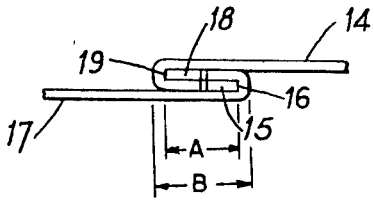

FIGS. 5 and 6 are sectional views only through the material of a lap seam being made which are taken in the planes defined by lines 5-5 and 6-6, respectively, of FIG. 1.

As previously discussed the novel folder or fold-over apparatus may be used as an independent piece of apparatus or physically combined with one or more pieces of apparatus for making lap seams depending upon the manufacturing requirements of the environment. Thus, there can be no single preferred embodiment. To facilitate description only, the table portion of the novel folder is shown and will be described as being the same table or material supporting surface for a double edge guide, and single and twin needle sewing heads.

Referring now to the drawings, and particularly to FIG. 1, the novel folder 12 is shown in one of the preferred embodiments previously described in which all components or pieces of apparatus are connected together in axial or longitudinal alignment along a mean axis x-x of the path of movement of the material or cloth by single table T. Two pieces of material or cloth 14 and 17 are fed (from the right as viewed from FIG. 1) through a double edge guide 10, to establish a web or an overlap (see FIG. 6) of material of a constant width A to a single needle head 11 which stitches the web or overlapped portions of material 15 and 18 together preferably midway between the cut edges 16 and 19 of the pieces of material or cloth 14 and 17, respectively.

The web or sewn overlapped portions 15 and 18 of the pieces of material 14 and 17, respectively, are rotated 180° or inverted as they feed axially or longitudinally through the novel folder 12 to form a lap seam as shown in FIG. 6 and, therefore, appropriately stitched along both folds by the twin needle head 13.

It should be fully understood that the overlapped portions of material 15 and 18 could be alternatively joined together by a suitable thermoplastic bonding material as described and shown in FIG. 7 of our aforenoted application Ser. No. 250,814.

Referring also to FIGS. 2 to 4, the novel folder or foldover apparatus 12 is provided with a pocket, well or recess 20 in the top surface of the table T which is generally of a delta or a bicycle saddle shape being wider and deeper at the feed-in or up-stream end and becoming progressively narrower and more shallow at the feed-out or down-stream end. Cooperating with the well 20, the folder 12 is provided with three blades, material guides or tongues 22, 25, and 27. While the blade or material guide 27 is fixedly mounted to or on the top surface of the table T, the guides or blades 22 and 25 are preferably adjustably supported by any suitable support or frame means 21 (shown in part) which is of any conventional construction well known in the art. Alternatively, the well 20 could be an opening through the table T.

The tongue 22 is spaced above the inlet or upstream end of the well 20 with its downstream end 24 positioned to urge the web or sewn overlapped portions 15 and 18 toward the well bottom which draws the cloths 14 and 17 toward each other in opposite lateral directions toward the axis X—X of the path of movement, and provides slack to permit rotation or folding of the web or joined overlapped portions 15 and 18. An inlet portion 23 of the tongue 22 is appropriately spaced from table T to ensure that the joined overlapped portions of cloth pass under the tongue 22 after leaving the single needle head 11.

In effect, the blades 25 and 27 are mounted and extend axially or longitudinally along opposite sides of the well 20 with their respective control edges 26 and 29 initially spaced laterally from one another at the upstream ends of the blades adjacent said tongue 22 and shaped to form a receiver for engaging the respective cut edges 16 and 19 of the pieces of material 14 and 17, respectively. The control edges 26 and 29 extend axially or longitudinally from the formed receiver along the well 20 and also laterally in opposite directions to one another where at a point intermediate the ends of blades 25 and 27, the control edges cross over one another so that blade 27 overlaps blade 25 and the control edges are laterally spaced at the down-stream ends of the blades or at the down-stream end of the well or opening 20 in the reverse direction from the lateral spacing at the up-stream ends of the blades.

Since the depressing effect of the tongue 22 provides slack in the material and blade 27 initially elevates the upper cloth 14 from the well 20 while blade 25 tucks and maintains the cloth 17 adjacent the bottom of the well, the web or overlapped material 15/18 moving axially or longitudinally is caused to simultaneously rotate by the reversed lateral spacing of the control edges 26 and 29.

The folder blade 27, mounted on one side of the well 20 on the upper surface of the table T, is curved downwardly at its upstream end 28 adjacent said tongue 22 into contact with the bottom of the well. If the well 20 is merely an opening, the blade end 28 must be lower than the lowermost part 24 of the tongue 27. The blade 27 engages the underside of the upper piece of cloth 14 initially urging it upwardly out of the well 20, and is provided with the control edge 29 which engages and urges the cut edge 19 to progressively move laterally from one side of the well 20 to the other as the web or overlapped material 15/18 moves axially or longitudinally toward the twin needle head 13.

Folder blade 27 with its control edge 29 is actually a seam positioning guide which controls the position of one of the seam folds and urges the upper material 14 and the web or overlapped material 15/18 laterally from one side of well 20 to the other as the material and web move axially or longitudinally through the novel folder. Blade 25 with its control edge 26 is actually a tucker urging the web 15/18 to fold under the upper material 14 and over the lower material 17 while controlling the other fold beneath the web and the lower material which is urged to move laterally in a direction opposite to the lateral movement of the fold between the web and the upper material 14.

Accordingly, as the web or joined overlapped material 15/18 moves axially or longitudinally along its path generally defined by means axis X—X, tongue 22 urges the web overlap into the well 20 where the tucker blade 25 and the guide or folder blade 27 cooperate to cause the web or overlapped cloth 15/18 to invert or rotate 180° folding the cloth 14 around the cut edge 19 of cloth 17 and the cloth 17 around the cut edge 16 of cloth 14 as shown in FIG. 6 which is taken in the plane 6—6 of FIG. 1. The overlapped cloth 15/18 in an intermediate position as it is being rotated is shown in FIG. 5 taken in the plane 5—5 of FIG. 1.

The effective constant width of the formed lap seam leaving the folder or fold-over apparatus 12 is designated B and seam stitches provided by the twin needle head 13 are preferably inward of the constant overlap designated A in FIG. 6 so that two rows of stitches each pass through four layers of cloth.

It should be readily realized that the overlapped portions of material 15 and 18 in effect form an intermediate web and once the control edges 26 and 29 engage the cut edges 16 and 19, respectively, the web space between the control edges 26 and 29 remains constant corresponding to the constant width of the overlapped portions of material regardless of the relative angular positions of the control edges to each other.

Therefore, the novel folder in combination with a twin needle head is capable of making a false or decorative lap seam along the length of a single piece of cloth. The constant spacing of the control edges 26 and 29 will define a web and the changing relative angular positions of the control edges will cause the defined web to rotate 180° forming a Z-type fold or constantly spaced folds between the web and the material laterally outward therefrom. The twin needle head will provide a spaced pair of rows of stitches immediately inward of the folds.

It should be obvious that mirror images of the tucker and folder blades positioned on opposite sides of the recess 20 from the blades 25 and 27 will make a reverse Z-fold.

Although but a single embodiment of the invention has been illustrated and described in detail, it is to be expressly understood that the invention is not limited thereto. Various changes may be made in the design and arrangement of parts without departing from the spirit and scope of the invention as the same will now be understood by those skilled in the art.

What is claimed is:

1. A folder for making Z-type folds in material, comprising a material supporting surface having an opening extending longitudinally in the direction of travel of the material to be folded;

a blade spaced above said surface extending downwardly into said opening forming a tongue depressing the material causing a slack in the material to be folded;

a pair of folder blades extending along opposite sides of said opening from adjacent said tongue at one end to the down-stream end of said opening at the other end with one of said blades positioned to contact the top surface of the material and the other of said blades positioned to contact the bottom surface of the material;

said folder blades having laterally spaced control edges adjacent said tongue which cross over one another and are laterally spaced in a reverse direction at the dow-stream end of said opening;

said folder blades cooperating to urge the slack portion of the material around said control edges and between said folder blades thereby forming a Z-type fold as the material moves through said folder.

2. The folder in accordance with claim 1, and the end adjacent said tongue of said folder blade positioned to contact the bottom surface of the material is disposed in said opening and said blade extending upwardly to said material supporting surface at its other end; and the end adjacent said tongue of said folder blade positioned to contact the top surface of the material extends downwardly into said opening and said blade being spaced below said other folder blade at its other end.

3. The folder in accordance with claim 2, and blade mounting means for adjusting the position of one of said folder blades relative to the other.

4. The folder in accordance with claim 3, and said opening in said supporting surface being a recess; and the end adjacent said tongue of said folder blade positioned to contact the bottom of the material being in contact with the bottom of said recess.

5. The folder in accordance with claim 1 for folding overlapped pieces of material which are joined together and having spaced cut edges, wherein said tongue urging the overlapped material into said opening;

one of said folder blades contacting the bottom surface of the uppermost piece of material with its control edge engaging the cut edge of the other piece of material and the other of said folder blades contacting the top surface of the other piece of material with its control edge engaging the cut edge of the uppermost piece of material thereby forming a Z-type fold enclosing the overlapped material.

6. The folder in accordance with claim 5, and the end adjacent said tongue of said folder blade positioned to contact the bottom surface of the material is disposed in said opening and said blade extending upwardly to said material supporting surface at its other end; and the end adjacent said tongue of said folder blade positioned to contact the top surface of the material extends downwardly into said opening and said blade being spaced below said other folder blade at its other end.

7. The folder in accordance with claim 6, and blade mounting means for adjusting the position of one of said folder blades relative to the other.

8. The folder in accordance with claim 7, and said opening in said supporting surface being a recess; and the end adjacent said tongue of said folder blade positioned to contact the bottom surface of the material being in contact with the bottom of said recess.

* * * * *

UNITED STATES PATENT AND TRADEMARK OFFICE

CERTIFICATE OF CORRECTION

PATENT NO. : 4,476,792

DATED : October 16, 1984

INVENTOR(S) : George P. Diacont et al.

It is certified that error appears in the above-identified patent and that said Letters Patent is hereby corrected as shown below:

Column 4, line 54, "dow-stream" should read -- down-stream --.

Signed and Sealed this

*Sixteenth* Day of *April 1985*

[SEAL]

*Attest:*

DONALD J. QUIGG

*Attesting Officer*

*Acting Commissioner of Patents and Trademarks*